US010172501B2

(12) United States Patent
Gscheidmeier et al.

(10) Patent No.: US 10,172,501 B2
(45) Date of Patent: Jan. 8, 2019

(54) PAPER TOWEL DISPENSER WITH ROLL HOLDER AND ROTATING PLUG ASSEMBLY

(71) Applicants: Jason Gscheidmeier, Hickory, NC (US); Patrick Miller, Hickory, NC (US)

(72) Inventors: Jason Gscheidmeier, Hickory, NC (US); Patrick Miller, Hickory, NC (US)

(73) Assignee: Von Drehle Corporation, Hickory, NC (US)

( * ) Notice: Subject to any disclaimer, the term of this patent is extended or adjusted under 35 U.S.C. 154(b) by 264 days.

(21) Appl. No.: 14/850,278

(22) Filed: Sep. 10, 2015

(65) Prior Publication Data

US 2017/0071419 A1 Mar. 16, 2017

(51) Int. Cl.

| | |
|---|---|
| ***A47K 10/38*** | (2006.01) |
| ***A47K 10/16*** | (2006.01) |
| *A47K 10/32* | (2006.01) |

(52) U.S. Cl.

CPC ..... *A47K 10/38* (2013.01); *A47K 10/16* (2013.01); *A47K 2010/3233* (2013.01)

(58) Field of Classification Search

CPC . A47K 10/38; A47K 10/16; A47K 2010/3233
See application file for complete search history.

(56) References Cited

U.S. PATENT DOCUMENTS

| | | | | |
|---|---|---|---|---|
| 689,834 | A * | 12/1901 | Tilton | B65H 75/08 242/599.2 |
| 5,597,135 | A * | 1/1997 | Vandersteene | B65H 16/005 242/599.3 |
| 7,364,112 | B1 * | 4/2008 | Formon | A47K 10/3836 242/564.1 |
| 8,899,510 | B2 * | 12/2014 | Dean | B65H 16/005 242/596.7 |

* cited by examiner

*Primary Examiner* — William A. Rivera
(74) *Attorney, Agent, or Firm* — John H. Thomas, P.C.

(57) ABSTRACT

A hardwound paper towel dispenser cabinet includes a roll holder mounted inside the dispenser cabinet. The roll holder includes a male key stub on a face thereof. The face of the roll holder and the male key stub are open to the vertical axis of the dispenser cabinet. A rotating plug includes a bung collar and a disc rotatably connected to the bung collar. The rotating disc has a female key recess that mate with the male key stub portion of the roll holder. The bung collar is adapted to be fixed inside the end of a core of a roll of hardwound paper towel.

11 Claims, 7 Drawing Sheets

PAPER TOWEL DISPENSER WITH ROLL HOLDER AND ROTATING PLUG ASSEMBLY

The present invention relates generally to a paper towel dispenser system. More specifically, the dispenser includes a static roll holder adapted for use with a rotating plug inserted into the core of a roll of hardwound towel.

BACKGROUND

Paper towels are often stored as a continuous roll paper sheet, optionally perforated at regular intervals to define individual sections, and rolled into a cylindrical tube. The paper towel roll is housed in a container and dispensed by feeding the end of the roll through an opening, such as a slot. A user grasps the exposed end of the towel roll and pulls off a desired amount of towel or a predetermined segment of towel. In addition to the foregoing mechanical dispensers, there are electronic dispensers that may be actuated to unroll a predetermined, metered amount of paper towel for a user.

Unfortunately, existing paper towel dispensers have a number of shortcomings. First, the dispenser mechanisms used for dispensing paper towels can be complicated. For example, existing dispensers may include multiple mechanical and/or electrical moving parts that engage and rotate with the roll of paper towels during the dispensing of that towel during ordinary use. A potential danger is that the moving parts inside the dispenser may wear out or otherwise break during their regular duty lifetime. Therefore, it is necessary to either repair or replace the dispenser to fix the worn out or broken parts. At the very least, dispensers having multiple moving parts may inevitably require additional maintenance to keep them in proper working condition.

Additionally, dispensers may be specifically engineered for operation with a particular type or brand of hardwound paper towel. If a user installs an incorrect type of paper roll in the dispenser, then the overall operation of the dispenser can be degraded. This can led to premature repair or replacement of a dispenser or overall dissatisfaction with the dispenser. Therefore, product dissatisfaction can result even though it is the fault of the user who installs the improper roll of paper towel in the dispenser that causes potential problems with use.

Finally, the ordinary and routine replacement of paper towel rolls within a dispenser can be complicated depending on the particular roll holder mechanism deployed within the dispenser. If there are moving parts and complicated latching mechanisms, then it is therefore easier for maintenance personnel to inadvertently damage or destroy a dispenser mechanism.

SUMMARY

Accordingly, it is an object of the present invention to overcome the foregoing drawbacks. As will be explained, the hardwound paper towel dispenser described herein, whether mechanical or electrical, includes a static roller holder deployed inside the dispenser that mates with a rotating plug that is placed inside the core of the roll of hardwound paper towel. Therefore, each roll incorporates a rotating mechanism that is replaced with the installation of each new roll of hardwound paper towel in order to reduce the likelihood of overuse and wear of a rotating plug. Moreover, the mating mechanism between the support arm and the rotating plug is shaped so that only proper rolls of hardwound paper towel may be installed inside a particular dispenser assembly in order to prevent any problems of the improper installation of an incorrect roll of hardwound paper towel.

In one example, a hardwound paper towel dispenser system includes a dispenser cabinet adapted to support and house a roll of hardwound paper towel. A roll holder is mounted inside the dispenser cabinet, the roll holder comprising a male key stub on a face thereof, wherein the face of the roll holder and the male key stub are open to the vertical axis of the dispenser cabinet. A rotating plug comprises a bung collar and disc rotatably connected to the bung collar, wherein the rotating disc has a female key recess formed therein. The female key recess mates with the male key stub portion of the roll holder. The bung collar is adapted to be fixed inside the end of a core of a roll of hardwound paper towel. Whereby a roll of hardwound paper towel is rotatably mounted inside a dispenser cabinet with a rotating plug mounted on the roll holder. The shape of the male key stub and the female key recess may be a symmetric star shape, including a three-armed star, or a five-armed star. The male key stub and the female key recess may be a rectangular shape or maybe an asymmetric geometrical shape.

DETAILED DESCRIPTION

In the present invention, a rotating plug assembly is mounted in the hub of a roll of hardwound paper towel. This roll of hardwound paper towel is intended to be mounted inside a dispenser cabinet having a roll holder therein. The roll holder interacts and connects with the rotating plug to allow the roll of hardwound paper towel to rotate inside the towel cabinet. Importantly, the cabinet assembly does not include any rotating or moving elements that facilitate the rotation of the roll of hardwound paper towel. Instead the rotating component is the rotating plug, and a new rotating plug comes with each new roll of paper towel. Therefore, the life of the cabinet itself is enhanced, because there is no rotating component of the cabinet to wear out over multiple and extended use.

Additionally, the rotating plug is almost flush with the planar, flat side of a roll of the hardwound paper towel. Stated alternatively, there is not any nub or rod that sticks out from the core on the side of each roll of paper towel. Accordingly, the rolls of paper towel with the rotating plug described herein may be packaged and shipped very efficiently with almost no wasted space between rolls and the side of a box or shipping container.

Figure 1:
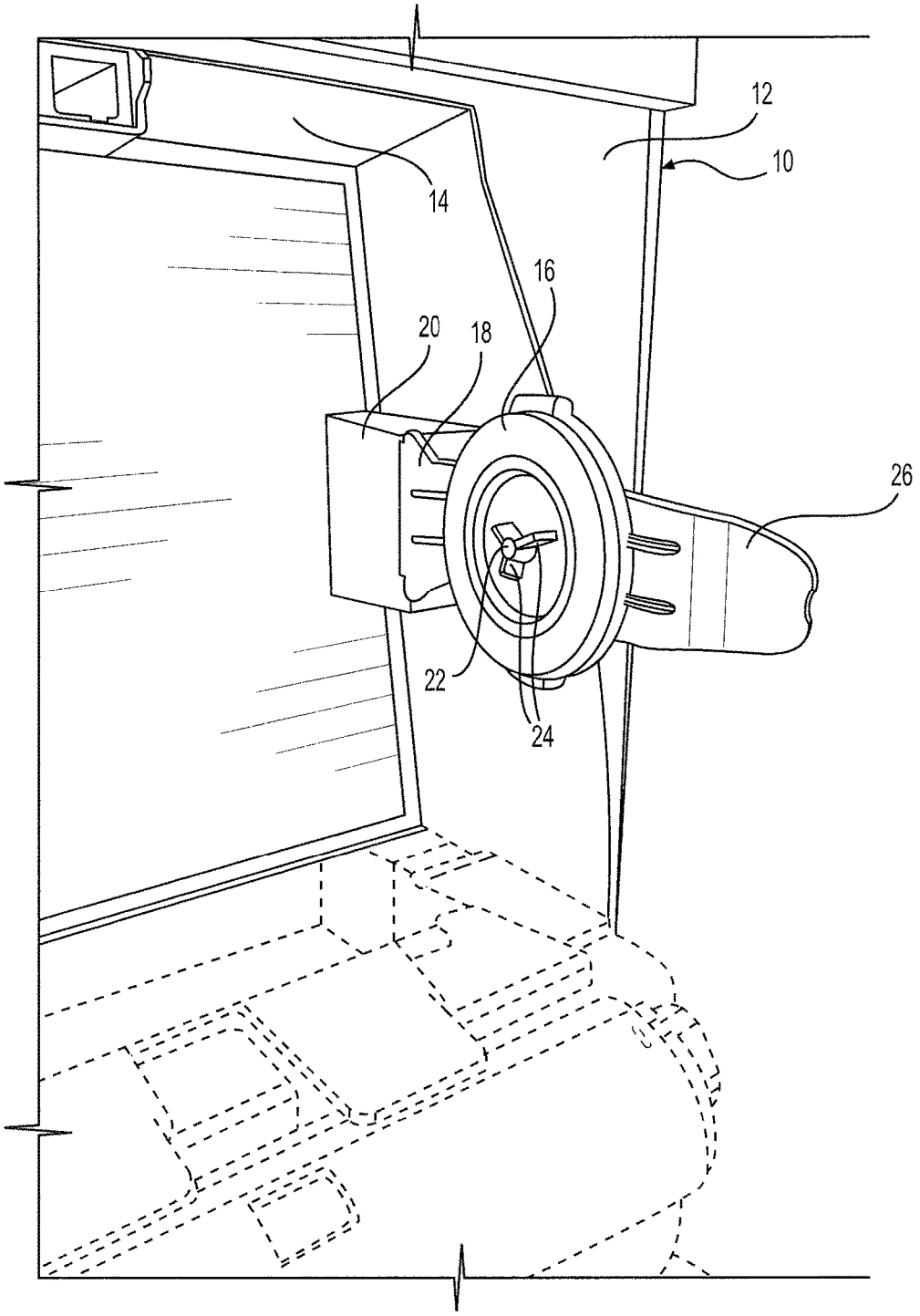
FIG. 1 is a perspective view of a cabinet for housing a roll of hardwound paper towel with the cover of the cabinet removed.

Turning now to the figures, FIG. 1 illustrates a hardwound paper towel cabinet 10. The cabinet 10 includes a cavity 14 which is adapted to receive a roll of hardwound paper towel. A roll holder 16 is mounted on an arm 26 that includes a hinge portion 18 that is hingedly connected to a base 20. The base 20 is fixed inside the housing 12. The roll holder 16 includes a male key stub 22 that, in this example, includes three fins 24 thereon. The face of the roll holder 16 and the male key stub 22 are open to a vertical axis of the cabinet 10.

Figure 2:
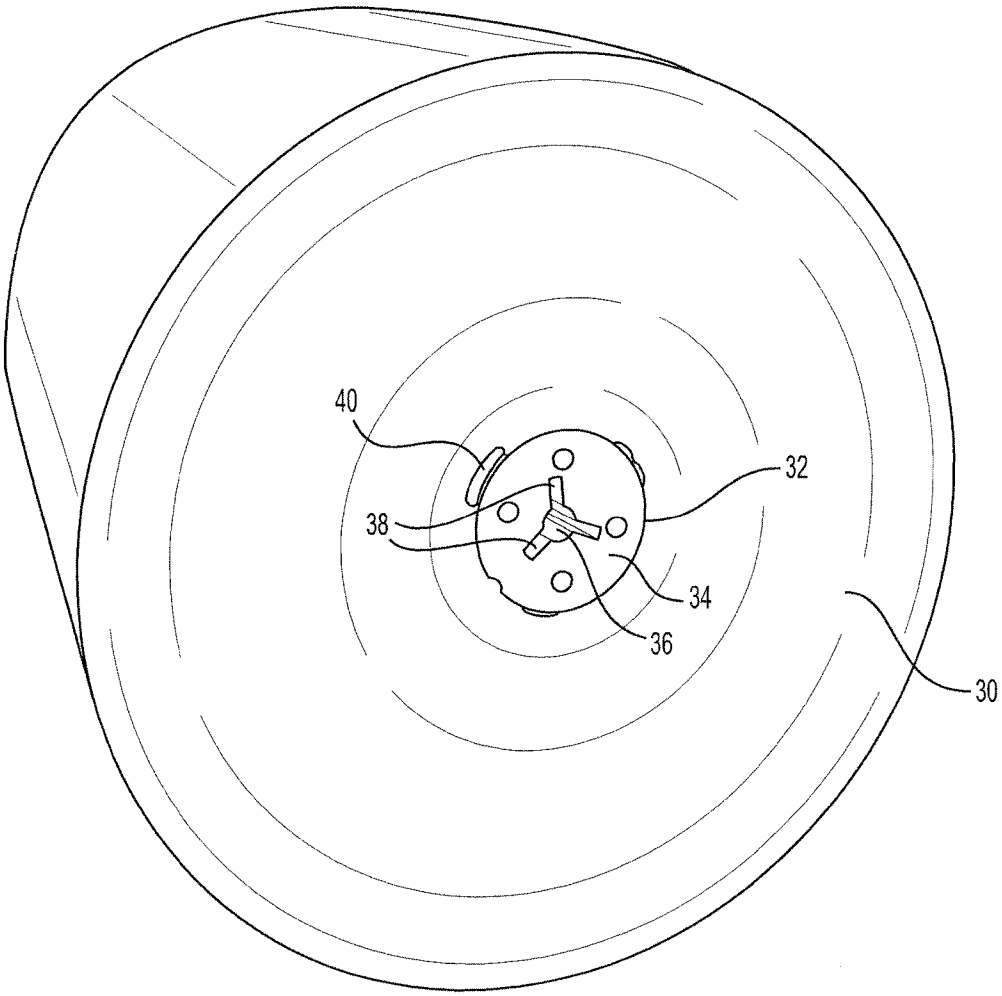
FIG. 2 is a perspective view of a roll of hardwound paper towel with a rotating plug assembly mounted in the hub thereof.

FIG. 2 illustrates a roll of hardwound paper towel 30 having a rotating plug 32 mounted in the core thereof. The rotating plug 32 includes tabs 40 that prevent the rotating plug 32 from being inserted too far into the core of the roll of hardwound paper towel 30 or coming into contact with the side of the core roll of paper. On the side surface of the rotating plug 30 there is a rotating disc 34 that includes a female key recess 36 formed therein. The female key recess 36 includes three female fin recesses 38.

Figure 3:
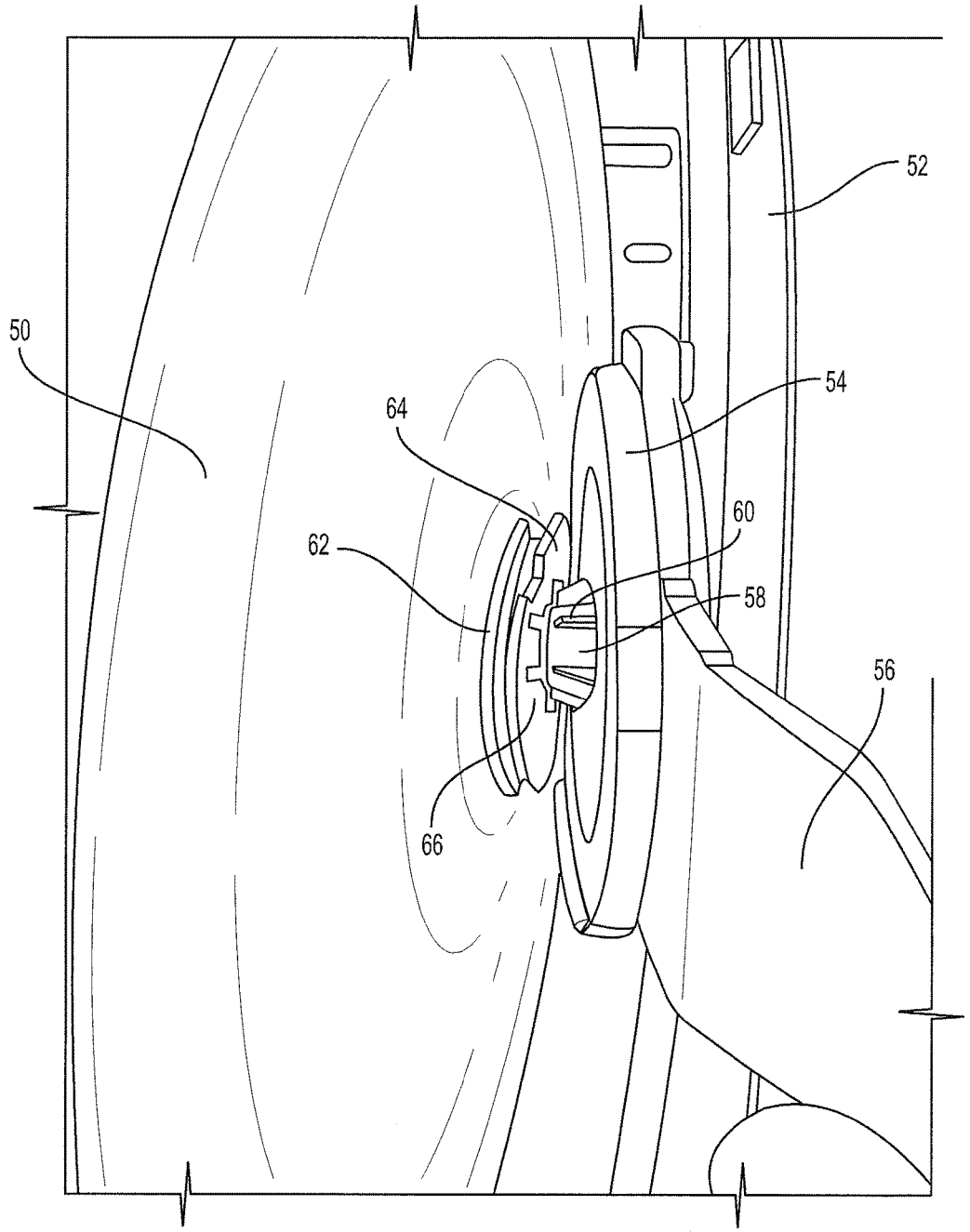
FIG. 3 is a perspective view that illustrates the interaction between a roll holder and a roll of hardwound paper towel.

FIG. 3 demonstrates the interaction between the roll holder and a roll of hardwound paper towel. In FIG. 3, the towel dispenser cabinet 52 has a roll holder 54 positioned therein. The roll holder 54 is mounted on a support arm 56 that is rotatably mounted inside the cabinet 52. The roll holder 54 includes the male key stub 58 having fins 60 thereon. The roll of hardwound paper towel 50 includes the bung 62 of the mount 64 fixed in the hub of that roll of hardwound paper towel. The rotating plug 64 includes a female key recess 66 that mates with the male key stub 58. During installation, a user moves the roll holder arm 56 outwardly and positions the roll inside the cabinet 52. When in position, the arm 56 is then released and biased into and toward the roll of hardwound paper towel 50 so that the male key stub 58 is inserted into the female key recess 66 portion of the rotating disc 64.

Figure 4:
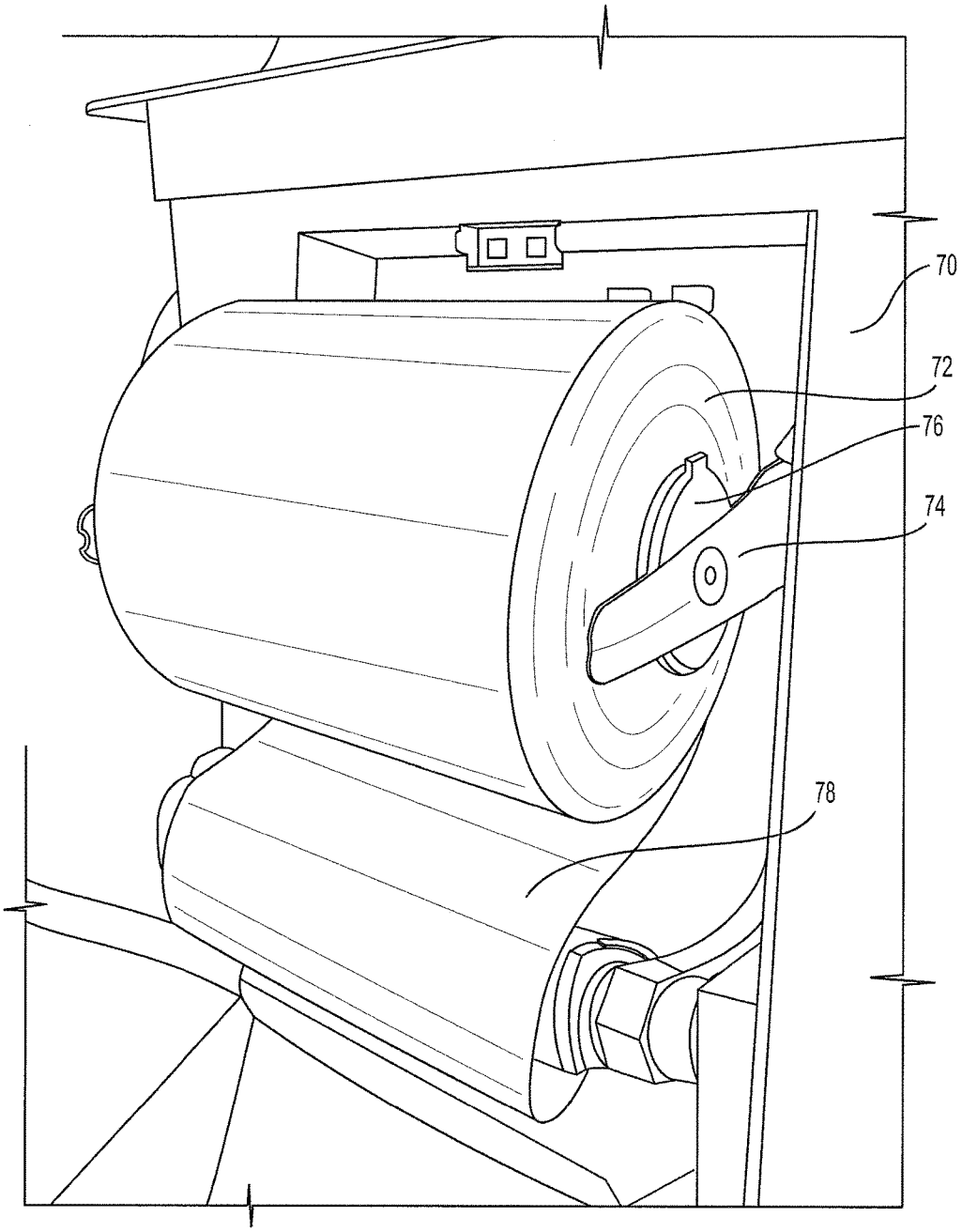
FIG. 4 is a perspective view of a cabinet having a roll of hardwound paper towel installed therein with the cover of the cabinet removed.

FIG. 4 illustrates a perspective view of a roll of hardwound paper towel 72 already installed inside a cabinet 70. As in all these views, there is a no cover that is shown, however, a hard plastic cover would be configured around the roll of hardwound paper towel to protect it from abuse when installed in a bathroom. The roll holder 76 is mounted on the arm 74 that is rotatably, hingedly fixed inside the cabinet 70. A tail portion 78 of a web of towel is shown feeding downwardly from the roll 72 of hardwound paper towel.

Figure 5:
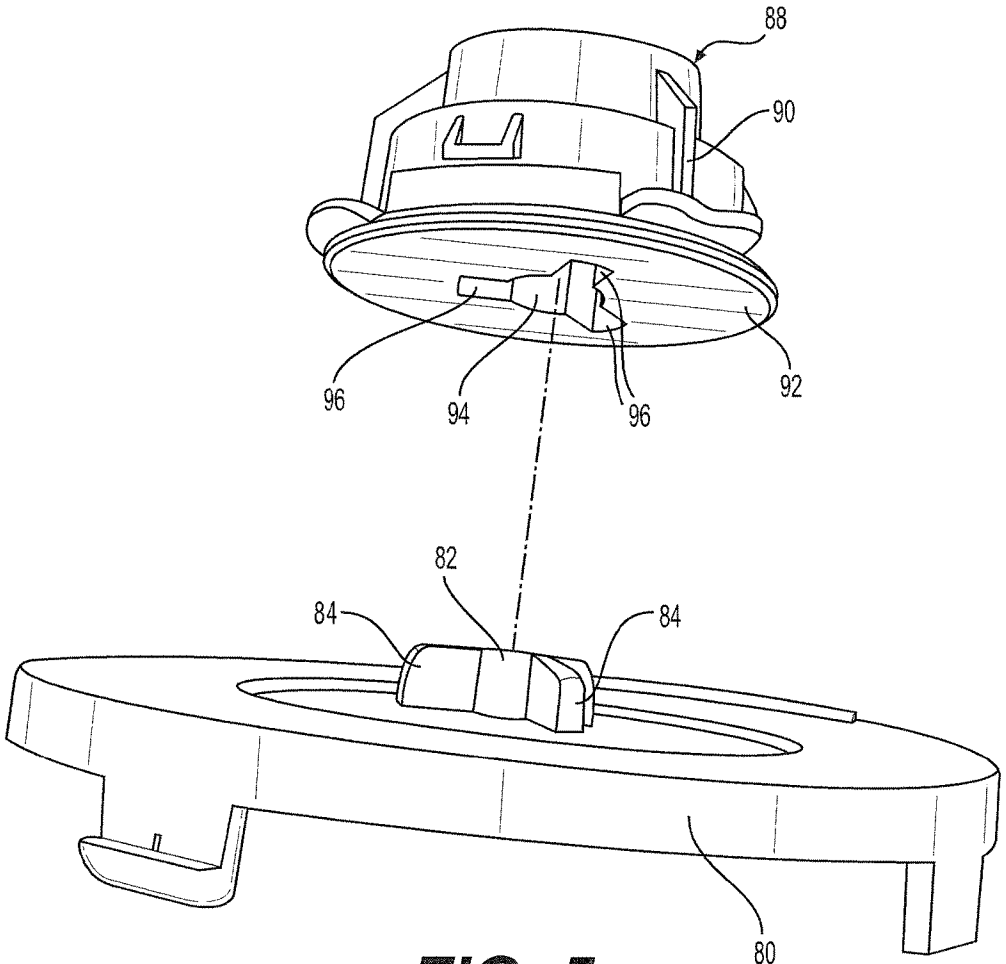
FIG. 5 is an exploded view of the roll holder and male key stub together with a rotating plug assembly.

FIG. 5 illustrates the roller holder 80 on one side as it is to be mated to the rotating plug 88 on the other side. The roller holder 80 includes the male key stub 82 having three fin portions 84. The rotating plug assembly 88 includes a bung 90 that is inserted into a core of hardwound paper towel. The bung 90 is adapted to press against and be fixed by friction in the hub of a roll of hardwound paper towel. Rotatably mounted in the bung 90 is a rotating disc 92. The rotating disc 92 includes the female key recess 94 and, in this example, three fin recesses 96 adapted to receive the fins 84 of the male key stub 82.

Figure 6:
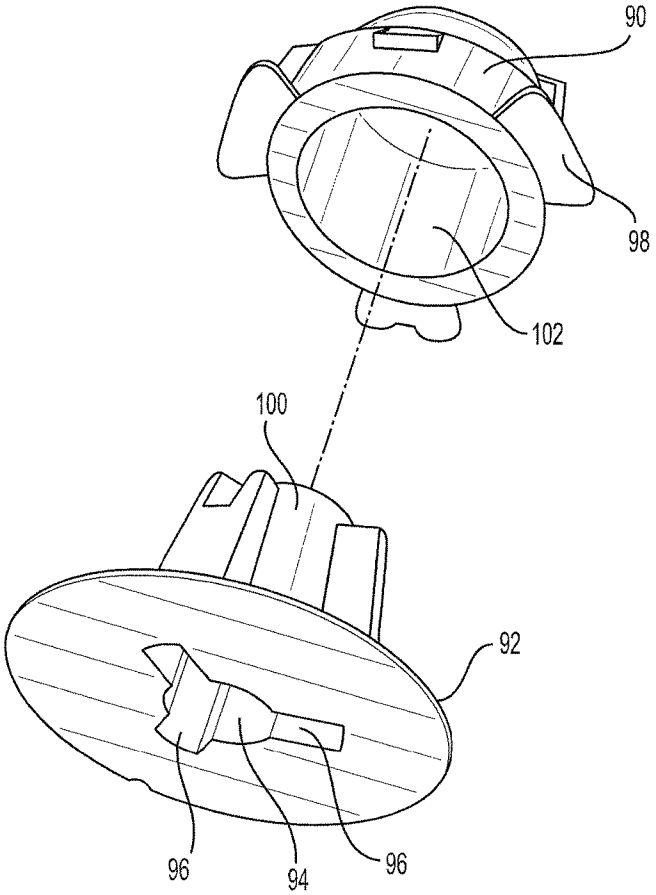
FIG. 6 is an exploded view of a rotating plug assembly showing the bung collar and rotating disc.
Figure 7A:
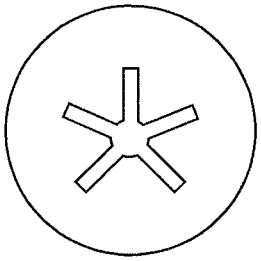
FIGS. 7A-G illustrate alternative classes of exemplary male/female key shapes.
Figure 7B:
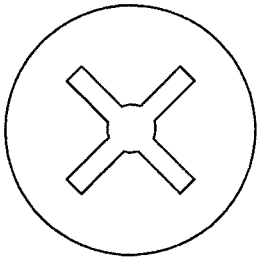
Figure 7C:
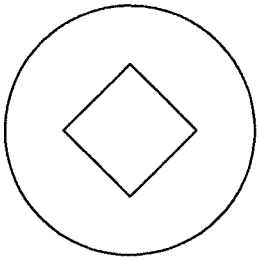
Figure 7D:
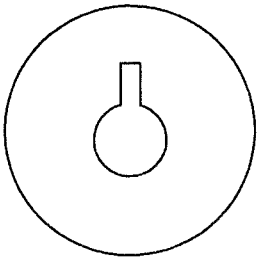
Figure 7E:
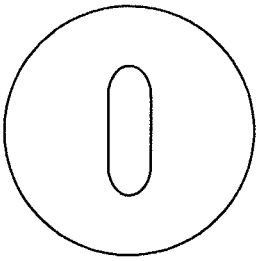
Figure 7F:
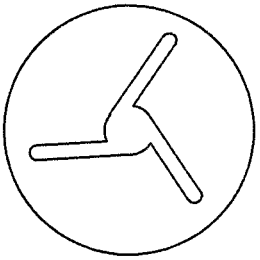
Figure 7G:
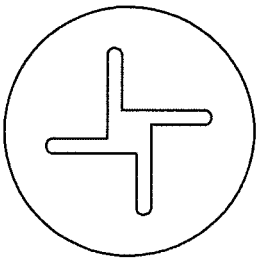

FIG. 6 illustrates the two component features of the rotating plug assembly. The bung 90 includes a round recess 102. The bung 90 includes tabs 98 that assist with preventing over insertion of the bung too far into the core of a roll of hardwound paper towel. The rotating disc portion 92 includes a male barrel 100 that is received in the aperture 102 of the bung 90. The rotating disc 92 includes a female key recess 94 formed therein having male key fin portions 96.

In other examples of the rotating plug and roll holder described herein, there may be various different geometries of the male key stub and the female key recess. This helps with ensuring that the correct roll of hardwound paper towel is installed within a particular towel cabinet. This assists with quality control and proper dimensional sizing of the roll of hardwound paper towel that is appropriate for a given cabinet.

FIGS. 7A-G illustrate alternative female key recess options such as a five arm star, a four arm star, a diamond shape, an asymmetric single arm, an oval, three arm (offset, with round center) and four arm (offset, with square center) star shapes in FIGS. 7A-G respectively. Of course, other shapes could be used. These different shapes may indicate different sizes or types of rolls. As a still further example, the rotating plug and the roll holder may be color-coded so that red plugs, for instance, are intended to be used with red roll holders. Other types of coding between the roll holder and the rotating plug are possible.

Also, as best illustrated in FIGS. 2 and 3, the rotating plug has a very low profile with respect to the planar side surface of the roll of hardwound paper towel. Preferably, the face of the rotating disc portion of the rotating plug is substantially parallel to and almost flush with the planar side of the roll of hardwound paper towel. Alternatively, the rotating disc surface can extend approximately 1 to 10 millimeters, or about 2 to 6 millimeters, or further about 3 to 4 millimeters from the substantially parallel and planar side surface of the roll of hardwound paper towel. This resulting low profile attribute means that the roll of hardwound paper towel can be packed very economically and shipped with minimal to no wasted space between rolls.

Other embodiments of the present invention will be apparent to those skilled in the art from consideration of the specification. It is intended that the specification and figures be considered as exemplary only, with a true scope and spirit of the invention being indicated by the following claims.

What is claimed is:

1. A hardwound paper towel dispenser system comprising:

a dispenser cabinet adapted to support and house a roll of hardwound paper towel;

a roll holder mounted inside the dispenser cabinet, the roll holder comprising a non-rotating male key stub on a face thereof, wherein the face of the roll holder and the male key stub are open to the vertical axis of the dispenser cabinet;

and a rotating plug comprising a bung collar and a disc rotatably connected to the bung collar, wherein the rotating disc has a female key recess formed therein;

wherein the female key recess mates with the male key stub of the roll holder;

and further wherein the bung collar is adapted to be fixed inside the end of a core of a roll of hardwound paper towel;

wherein the face of the rotating disc facing a substantially parallel side surface of the roll extends about 1 to 10 millimeters from the substantially parallel side surface of the roll of hardwound paper towel;

whereby a roll of hardwound paper towel is rotatably mounted inside a dispenser cabinet with the rotating plug mounted on the non-rotating male key stub on the face of the roll holder.

2. A hardwound paper towel dispenser system as described in claim 1, wherein the roll holder is mounted in the dispenser cabinet and is biased toward the face of the roll holder toward the center vertical axis of the dispenser cabinet, whereby the male key stub is biased into the female key recess of the rotating plug when a roll of hardwound paper towel is mounted inside the dispenser cabinet.

3. A hardwound paper towel dispenser system as described in claim 1, wherein the shape of the male key stub and the female key recess is a symmetric star shape.

4. A hardwound paper towel dispenser system as described in claim 1, wherein the symmetric star shape is a three-armed star.

5. A hardwound paper towel dispenser system as described in claim 1, wherein the symmetric star shape is a five-armed star.

6. A hardwound paper towel dispenser system as described in claim 1, wherein the shape of the male key stub and the female key recess is a rectangular shape.

7. A hardwound paper towel dispenser system as described in claim 1, wherein the shape of the male key stub and the female key recess is an asymmetric geometrical shape.

8. A hardwound paper towel dispenser system as described in claim 1, wherein the face of the rotating plug is adapted to be substantially flush with the side of the roll of hardwound paper towel once the bung collar is fixed inside the core of the roll of hardwound paper towel.

9. A hardwound paper towel dispenser system as described in claim 1, wherein the outside face of the rotating disc extends about 2 to 6 millimeters from the substantially parallel side surface of the roll of hardwound paper towel.

10. A hardwound paper towel dispenser system as described in claim 1, wherein the face of the rotating disc facing the substantially parallel side surface of the roll extends about 3 to 4 millimeters from the substantially parallel side surface of the roll of hardwound paper towel.

11. A hardwound paper towel dispenser system as described in claim 1, wherein the face of the rotating disc is substantially parallel to the side surface of the roll of hardwound paper towel.

* * * * *